US005423530A

United States Patent [19]

Alvarez González

[11] Patent Number: 5,423,530

[45] Date of Patent: Jun. 13, 1995

[54] DEVICE FOR THE PRACTICE OF GOLF

[76] Inventor: Pedro Alvarez González, Ronda del Canigó, Agrupación 5, Casa 3, Barcelona (Esplugues Del Llobregat), Spain, 08950

[21] Appl. No.: 312,453

[22] Filed: Sep. 26, 1994

[30] Foreign Application Priority Data

Dec. 14, 1993 [EP] European Pat. Off. ..... 93500163

[51] Int. Cl.[6] ..... A63B 57/00

[52] U.S. Cl. ..... 273/32 D; 273/32 A; 224/918

[58] Field of Search ..... 273/32 R, 32 A, 32 B, 273/32 D; 224/918

[56] References Cited

U.S. PATENT DOCUMENTS

| | | | |
|---|---|---|---|
| 2,768,775 | 10/1956 | Houser | 224/918 X |
| 3,298,579 | 1/1967 | Smith | 224/918 X |
| 3,497,118 | 2/1970 | Najjar | 224/918 X |
| 4,730,728 | 3/1988 | Larkin | 224/918 X |
| 4,850,483 | 7/1989 | Stack | 273/32 A X |
| 4,960,239 | 10/1990 | Wait | 273/32 B |

*Primary Examiner*—William H. Grieb
*Attorney, Agent, or Firm*—Richard M. Goldberg

[57] ABSTRACT

A device for the practice of golf includes a base plate with two clasps (10) to fasten it to the waist. Base (1) has two nipping appendages (2) for two balls (4) which can be extracted easily, and two partitions (7) with holes for both TEES, holding a shield (8) with a button (10), for marking the position of the ball.

17 Claims, 1 Drawing Sheet

DEVICE FOR THE PRACTICE OF GOLF

BACKGROUND OF THE INVENTION

The aim of the invention is a device for the practice of golf, particularly useful for the amateur who plays alone or in company without assistance, in comparison with the case of people of high economic standard who are members of private clubs.

This kind of amateur carries a reduced amount of equipment and walks from hole to hole until he finishes the game.

The author does not know any patent application he could mention as an antecedent. It constitutes an original idea, the practical realization of which will be further explained, and no similar device has been found in the market which could serve for the same purpose as this device for the practice of golf.

According to the statistics, in the Western world a hundred million people play golf, of which only three million play in luxury resorts with all the necessary equipment.

According to the statistics, there is a considerable market for the device of this invention, since all those people who play alone without assistance are potential clients for this device, which would be very helpful for them all through the golf game.

In fact, there are several times when a ball is lost or a marker of the position of the ball is necessary when it is near a hole in the middle of a game.

It is also frequent that, when beginning a new hole, you have to hit the base and you do not find a TEE at hand.

Then, in all cases it is necessary to go back to look for another ball or other equipment, and the player has to walk from hole to hole at least three times.

This invention aims to provide the player with a new device for the practice of golf which would allow him to carry in a very comfortable way all those items, except for the clubs, thus solving the problems mentioned above.

SUMMARY

The invention consists of a base plate with two nipping tubular appendages able to lodge and retain two golf balls.

The base plate is slightly curved, so that it can adapt longitudinally to the waist of the user, incorporating both clasps to fasten it to the belt.

Between these tubular appendages there are two partitions which join the adjacent parts of both and from a space where a front shield can be interlocked.

The front shield provides a space to insert and retain, with the possibility of extraction, a marker of the position of the ball when it is near a hole and the ground has to be cleared out for another putt.

The partitions are perforated, thus providing a space to put both TEES, so that they are always at hand when starting a new hole.

The tubular appendages have two openings with nipping effect so that they can retain balls of the American type (4,27 cm. diameter) or of the English type (4,11 cm.).

The retaining of the balls is complemented and intensified with a series of internal edges or grooves in the opening.

Some openings in the base plate give the possibility to force the balls out, although the lateral openings of the tubular appendages are enough to facilitate the extraction of the balls.

DESCRIPTION OF THE DRAWINGS

Some drawings are attached to this document in order to complement what has been explained before. These drawings show two figures.

DESCRIPTION OF AN EXAMPLE OF REALIZATION

Figure 1:
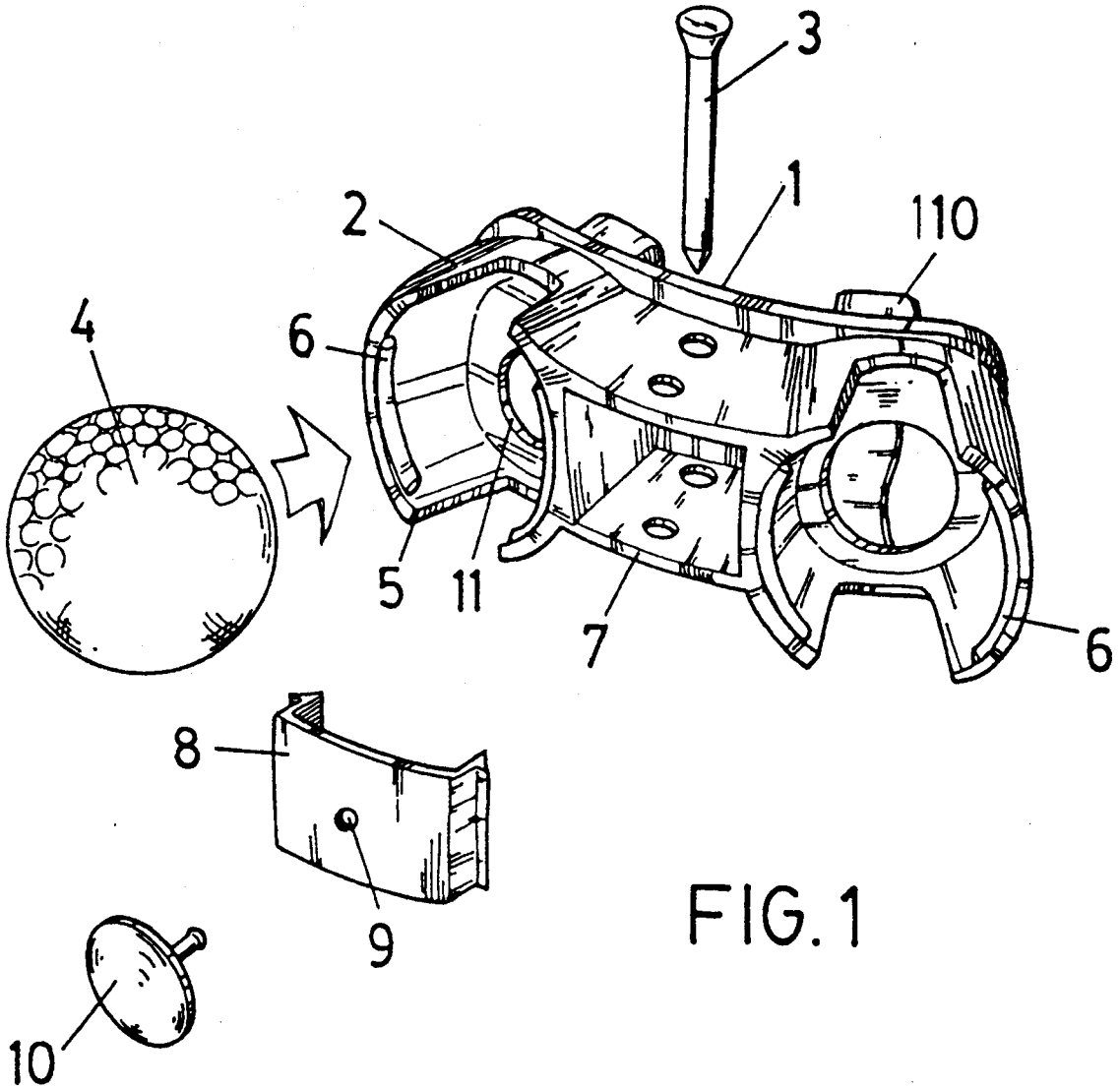
FIG. 1 is an exploded perspective of the different pieces of the device.
Figure 2:
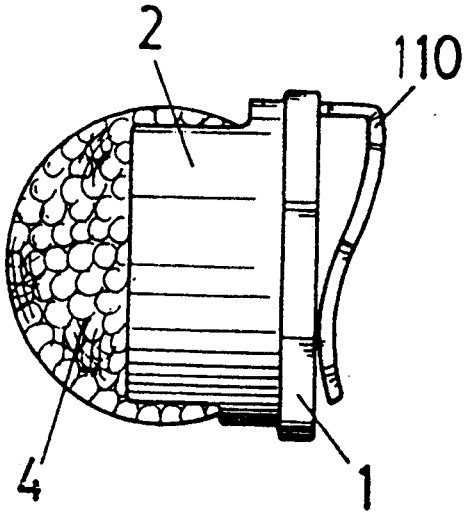
FIG. 2 is a side elevation.

It can be noticed in the drawings that the device consists of a base plate (1) which is slightly curved so that it can be adapted longitudinally to the waist of the golf player. Base plate (1) has clasps (110) on one side for fastening to a belt of a person.

Base plate (1) has two tubular appendages (2) on the other side, able to lodge and retain two golf balls (4).

Each one of these tubular appendages (2) present, diametrically and in vertical sense, two openings 5 in which the fingers can be introduced to extract balls (4).

They can be introduced by pushing them into the opening, which gives way due to the openings (5) which also give the tubular appendages (2) a nipping effect, since they have in the interior part of the opening some edges or grooves (6).

Two partitions (7) join the appendages and fasten them to the base (1); these partitions constitute a place for a shield (8) that at the same time incorporates a space (9) for the button (10), which marks the position of the ball near the hole.

In each partition (7) there are at least two holes to put at least two TEES, so that the set constitutes a device to carry all the equipment in the waist, since behind base plate (1) there are two clasps (110). Two holes (11) make it lighter and allow to force the ball (4) out if it gets stuck.

Since the device can be turned into an advertising item, it must be said that promotional or other signs which can be identified with trademarks or sponsors can be indicated both in shield (8) and in button (10).

I claim:

1. A device for the practice of golf, comprising:

a base plate which can be fastened to a belt about a waist of a person;

two appendages adapted to receive golf balls therein, each appendage being defined by two diametrically opposite, arcuate fingers, at least one finger of each appendage having an edge on an inner surface thereof to retain a golf ball between the two fingers of each appendage;

two partitions positioned between said two tubular appendages and which define a space therebetween, each partition having at least one hole for receiving a golf tee therein;

said tubular appendages and partitions being connected to one side of said base plate; and a shield covering said space for holding a button used to mark a position of a golf ball.

2. A device according to claim 1, further comprising at least one clasp means secured to an opposite side of said base plate for securing said device to the belt about the waist of the person.

3. A device according to claim 2, wherein there are two said clasp means spaced apart along said base plate.

4. A device according to claim 1, wherein each said edge is formed adjacent a free end of the respective tubular appendage.

5. A device according to claim 1, wherein said shield has a small hole therein for receiving a stem of the button.

6. A device according to claim 1, wherein said base plate has two openings; and said two tubular appendages are aligned with said two openings to facilitate extraction of the golf balls therefrom.

7. A device according to claim 1, wherein each said partition has at least two said holes for receiving golf tees therein.

8. A device for the practice of golf, comprising:

a base plate which can be fastened to a belt about a waist of a person, said base plate having two openings;

two tubular appendages adapted to receive golf balls therein and being aligned with said two openings to facilitate extraction of the golf balls therefrom, each appendage having an opening for introducing fingers of a person and an edge to retain the golf balls therein;

two partitions joining together said two tubular appendages and which define a space therebetween, each partition having at least two holes for receiving golf tees therein;

said connected tubular appendages and partitions being connected to one side of said base plate; and a shield covering said space for holding a button used to mark a position of a golf ball.

9. A device according to claim 8, further comprising at least one clasp means secured to an opposite side of said base plate for securing said device to the belt about the waist of the person.

10. A device according to claim 9, wherein there are two said clasp means spaced apart along said base plate.

11. A device according to claim 8, wherein each said opening for introducing fingers of a person is formed by at least one cut-out portion of the respective tubular appendage.

12. A device according to claim 11, wherein each said opening for introducing fingers of a person is formed by two diametrically opposite cut-out portions of the respective tubular appendage.

13. A device according to claim 8, wherein each said edge is formed at an inner wall of the respective tubular appendage and adjacent a free end of the respective tubular appendage.

14. A device according to claim 8, wherein said shield has a small hole therein for receiving a stem of the button.

15. A device for the practice of golf, comprising:

a base plate which can be fastened to a belt about a waist of a person, said base plate having two openings;

two tubular appendages adapted to receive golf balls therein and being aligned with said two openings to facilitate extraction of the golf balls therefrom, each appendage having an opening for introducing fingers of a person and an edge to retain the golf balls therein, each said opening for introducing fingers of a person being formed by two diametrically opposite cut-out portions of the respective tubular appendage, and each said edge being formed at an inner wall of the respective tubular appendage and adjacent a free end of the respective tubular appendage;

two partitions joining together said two tubular appendages and which define a space therebetween, each partition having at least two holes for receiving golf tees therein;

said connected tubular appendages and partitions being connected to one side of said base plate;

a shield covering said space for holding a button used to mark a position of a golf ball; and at least one clasp means secured to an opposite side of said base plate for securing said device to the belt about the waist of the person.

16. A device according to claim 15, wherein there are two said clasp means spaced apart along said base plate.

17. A device according to claim 15, wherein said shield has a small hole therein for receiving a stem of the button.

* * * * *